United States Patent [19]

Travis

[11] Patent Number: 5,041,015

[45] Date of Patent: Aug. 20, 1991

[54] ELECTRICAL JUMPER ASSEMBLY

[75] Inventor: Lawrence R. Travis, Anaheim, Calif.

[73] Assignee: Cal Flex, Inc., Anaheim, Calif.

[21] Appl. No.: 502,518

[22] Filed: Mar. 30, 1990

[51] Int. Cl.[5] ..... H01R 9/07

[52] U.S. Cl. ..... 439/492; 439/741

[58] Field of Search ..... 439/67, 77, 492–499, 439/741, 870

[56] References Cited

U.S. PATENT DOCUMENTS

| | | | |
|---|---|---|---|
| 3,374,538 | 3/1968 | Murray | 29/856 |
| 3,601,755 | 12/1965 | Shiells, Jr. | 439/492 |
| 4,526,432 | 7/1985 | Cronin et al. | 439/320 |
| 4,749,356 | 7/1988 | Asai et al. | 439/67 |
| 4,812,130 | 3/1989 | Altenschulte et al. | 439/84 |

OTHER PUBLICATIONS

"Flexstrip Jumper System" brochure, dated 1982, T&B/Ansley.

"Sculptured Jumpers" brochure, dated 1977, Advanced Circuit Technology.

*Primary Examiner*—Neil Abrams

*Attorney, Agent, or Firm*—Spensley Horn Jubas & Lubitz

[57] ABSTRACT

The invention relates to an electrical jumper assembly for connecting electrical circuits. The electrical circuit comprises a flexible cable having one or more conductors which are encapsulated in an insulating material. Each conductor terminates at least at one end in a conductive pad having a hole for mating arrangement with a separate terminal pin. The terminal pin has a contact end which is inserted into the connector hole in the circuitry. The opposite end of the terminal pin extends beyond a stiffener and is preferably hollow which permits swaging the pin to the stiffener. A terminal pin flange located between the ends of the pin rest upon the conductive pad for physical and electrical contact. The flange can be soldered with high temperature solder to the conductive pad for additional stability and reduced resistance.

10 Claims, 2 Drawing Sheets

ELECTRICAL JUMPER ASSEMBLY

BACKGROUND OF THE INVENTION:

The present invention relates to the field of electrical connectors and more particularly to an electrical jumper assembly for connecting electrical or electronic circuits.

Various methods exist for connecting separate electrical circuitry residing on rigid printed circuit boards, or within flexible printed circuits. A common technique referred to as point-to-point wiring uses conventional round wire to make the connections. However, this technique results in two major disadvantages. First, point-to-point wiring has high installation costs when there are multiple connections within a confined area. Second, there is a tendency for the round wire to break at the termination point after repeated flexing.

Electrical jumpers are designed to address these problems. Typically, the electrical jumpers include a flexible cable having a set of flexible conductors which are maintained in insulated and spaced relationship from each other. The intermediate portions of the conductors are typically flat for flexibility and are encapsulated in an insulating material. The flat portions of the conductors serve to distribute the flexing stress over the length of the jumpers. Thus, the electrical jumpers can withstand more repeated flexing stress than conventional round wire before breakage occurs. The conductor ends, commonly known as terminal pins, extend beyond the insulating material for connection into printed circuit boards or other electrical components. The fixed spacing between terminal pins permits easy insertion into printed circuit board hole patterns. Lower installation costs can be realized, since the multiple terminal pins of the electrical jumpers can be inserted into the female connectors as a single unit.

One type of electrical jumper is disclosed in U.S. Pat. No. 3,601,755 to Shiells. The electrical jumper includes a plurality of round wires whose intermediate portion is flattened by a pressure roller. The flattened portion of the wires are sandwiched between two sheets of plastic in a laminated structure with the planes of the flattened portions being coplanar. The round ends of the wire extend beyond the insulating material and remain in their original condition for use as terminal pins. Thus, the terminal pins and the intermediate portion of the conductors connecting the pins consist of the same type of material. This results in a compromise as to the rigidity of the pins and the flexibility of the conductors. Consequently, the pins may be too soft and easily bent out of position during insertion into the connector holes, while the conductors may be too hard and lack adequate flexibility.

Another technique for manufacturing electrical jumpers includes the step of etching away the intermediate portion of the conductor to form the desired flat shape. The etching process removes less of the conductor ends to achieve the desired thicker and therefore more rigid terminal pins. In either approach, the terminal pins are an integral extension of the conductors, thereby compromising the rigidity of the pins and the flexibility of the intermediate portion of the conductors.

It is a purpose of the present invention to provide a low cost electrical jumper assembly which does not compromise the rigidity of the terminal pins or the flexibility of the intermediate portion of the conductors connecting such pins.

SUMMARY OF THE INVENTION

The present invention relates to an electrical jumper assembly for connecting electric circuits. The electrical jumper comprises a flexible cable having one or more conductors which are encapsulated in an insulating material. In one embodiment, the insulating material maintains a plurality of conductors in a spaced and insulated arrangement. Each conductor terminates at least at one end in a conductive pad. The conductive pad may form a variety of shapes as long as it is large enough to form a hole for mating arrangement with a separate terminal pin.

The terminal pin has a contact end which is inserted into the female connector of the circuitry, for example, a connector hole of a printed circuit board. The opposite end of the terminal pin extends through the flexible cable and through a stiffener to which it is secured. The opposite end of the terminal pin is preferably hollow which permits swaging the pin to the stiffener. The terminal pin has a flange located between the ends. The flange rests upon the conductive pad for physical and electrical contact. The flange is preferably soldered with high temperature solder to the conductive pad for additional stability and to reduce the resistance of the connection.

In this manner, the terminal pin and the flexible conductors can be made from entirely different materials to achieve the desired qualities. For example, the terminal pins can be made of a relatively hard alloy to ensure the pins are not bent out of position during assembly, whereas the flexible conductors can be made of a relatively soft alloy to ensure the conductors are highly flexible and can withstand repeated flexing without breakage.

DETAILED DESCRIPTION OF THE DRAWINGS

The following description is the best contemplated mode of carrying out the invention. This description is made for the purpose of illustrating the general principles of the invention and should not be taken in a limiting sense. The scope of the invention is best determined by reference to the appended claims. In the accompanying drawings like numerals designate like parts in the several figures.

Figure 1:
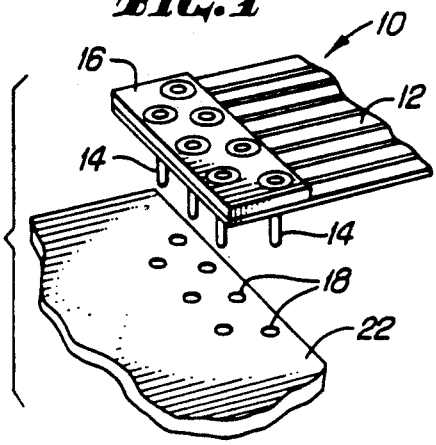
FIG. 1 is a perspective view of one embodiment of the electrical jumper having terminal pins arranged for termination with a set of connector holes in a printed circuit board.

FIG. 1 shows an example of an application where the electrical jumper 10 may be used to connect electrical circuitry. When this type of electrical jumper 10 is used, for example, to make a connection between external circuitry and a rigid printed circuit board, one end of the electrical jumper 10 may be plugged into a set of connector holes 18 in a printed circuit board 22. The set of connector holes 18 may be arranged in a variety of patterns but are shown for simplicity as consisting of two staggered rows. The electrical jumper 10 has a set of terminal pins 14 which are arranged to correspond to the positions of the connector holes 18. The electrical connection is made by plugging the terminal pins 14 into the connector holes 18. After insertion, the electrical jumper 10 may be wave soldered to provide a permanent connection or may be left alone for removable termination.

Figure 2:
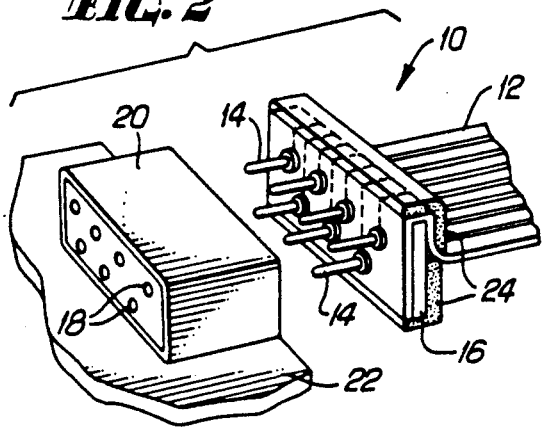
FIG. 2 is a perspective view of another embodiment of the electrical jumper having terminal pins which make straight engagement with a socket connector of a printed circuit board.

FIG. 2 shows another embodiment of the present invention which involves a modification of the electrical jumper 10 for straight engagement into a socket connector 20 which is mounted parallel to a printed circuit board 22. In this embodiment, the flexible cable 12 is wrapped around a stiffener 16 and held in place by a potting material 24. This potting material 24 can also serve to prevent electrical shorting of adjacent terminal pins 14 when the terminal pins 14 are wave soldered to the connector holes 18. It is also possible to use the potting material 24 (not shown in FIG. 1) to prevent electrical shorting between adjacent terminal pins 14 in the earlier embodiment illustrated in FIG. 1.

Figure 3:
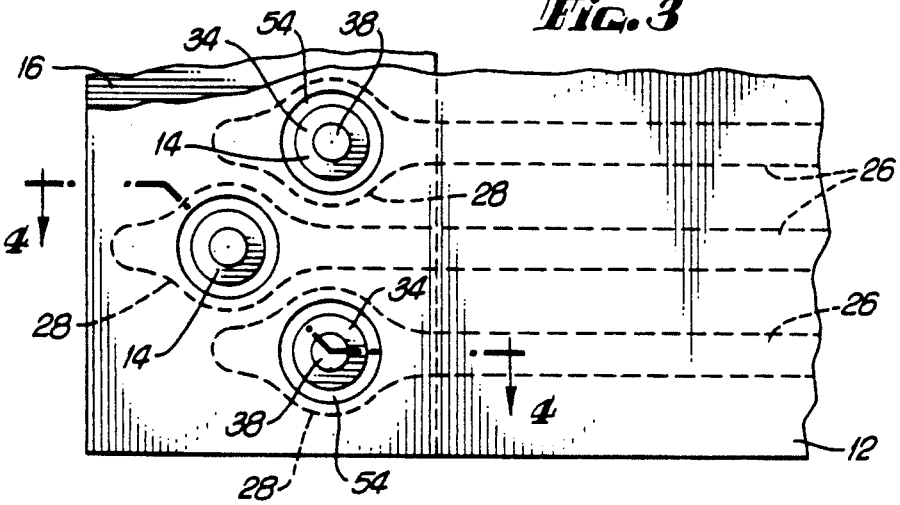
FIG. 3 is a plan view of an electrical jumper assembly illustrating the arrangement between the terminal pins, the conductive pads of the flexible conductors, and a stiffener bonded to the end portion of the flexible cable.

Reference is now made to FIG. 3 of the drawings, which illustrates one possible arrangement for the connection assembly of the electrical jumper 10. The electrical jumper 10 comprises a flexible cable 12 having a set of flexible conductors 26 which are maintained in spaced and insulated relationship from each other. The flexible conductors 26 terminate in conductive pads 28 which are arranged to correspond to the connector holes 18 (not shown). Each conductive pad 28 is connected to a terminal pin 14 which is fastened to the flexible cable 12 by being swaged over a stiffener 16 (see FIG. 1) which is bonded to the end portion of the flexible cable 12. The conductive pad 28 may assume a variety of shapes, but must be large enough to form a hole for mating arrangement with the terminal pin 14 and be small enough so that the adjacent conductive pads 28 do not touch each other.

Figure 4:
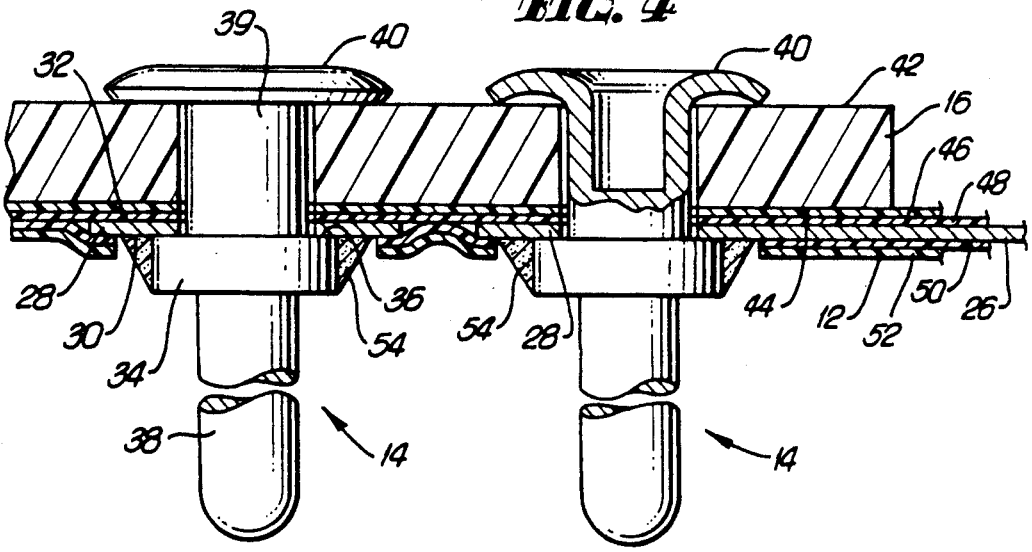
FIG. 4 is cross-sectional view of adjacent terminal pin assemblies taken on the line 4—4 of FIG. 3.

Reference is now made to FIG. 4 of the drawings which illustrates the electrical jumper assembly 10 and the flexible cable 12 in more detail. The flexible cable 12 generally includes a set of rolled and annealed flexible copper conductors 26 which are insulated from each other. Typically, the flexible conductors 26 are encapsulated in an insulating material such as a polyester, a polyamide or other like films. A suitable procedure for fabricating the flexible cable 12 is to print or laminate a sheet of copper on a bottom insulating layer 52 of plastic material such as Kapton and etch the copper to form the flexible conductors 26. The flexible conductors 26 are fixed in position by a bottom adhesive layer 50. A top insulating layer 46 of similar plastic material is then bonded by a top adhesive layer 48 to the flexible conductors 26. The adhesive layers 48 and 50 can be a variety of adhesives, including an acrylic adhesive, an epoxy, a polyester, or a phenolic butyral.

As mentioned earlier in connection with FIG. 3, each flexible conductor 26 terminates in a conductive pad 28 having a hole for mating arrangement with a terminal pin 14. Since the conductive pads 28 are encapsulated in plastic, the plastic covering the conductive pad 28 must be removed from the bottom insulating layer 52 of the flexible cable 12, so that the conductive pads 28 can physically contact the flange 34 of the terminal pins 14. The stiffener 16 also has predrilled holes which align with the holes of the conductive pads 28 for receiving the terminal pins 14. The stiffener 16 is preferably bonded to the top insulating layer 46 to provide mechanical support to the end portion of the flexible cable 12. The stiffener 16 also functions to protect the flexible circuit 12 from being damaged or stressed when the terminal pins 14 are swaged to the flexible cable 12.

Each terminal pin 14 shown in FIG. 4 has a contact end 38 which is inserted into the female connector of the circuitry (not shown). A standard terminal pin 14 is formed of a copper alloy such as brass with a tin finish. Other surface finishes including gold can be provided. The opposite end of the terminal pin 14 extends through the stiffener 16 and is preferably hollow which permits swaging the pin 14 to the stiffener 16. The swaged end 40 of the pin 14 forms a collar pinching down upon the outer surface 42 of the stiffener 16. The terminal pin 14 has a flange 34 located between the contact end 38 and the opposite non-contact end 39. The flange 34 has a contact surface 36 which rests upon the contact surface 30 of the conductive pad 28 for physical and electrical contact. The flange 34 is preferably soldered with high temperature solder 54 to the conductive pad 28 for additional stability and to reduce the resistance of the connection. The high temperature solder 54 is used rather than a lower temperature solder because it will not reflow when the terminal pin 14 is soldered to the bottom of the printed circuit board 22 from the conduction of heat up the pin 14.

Figure 5:
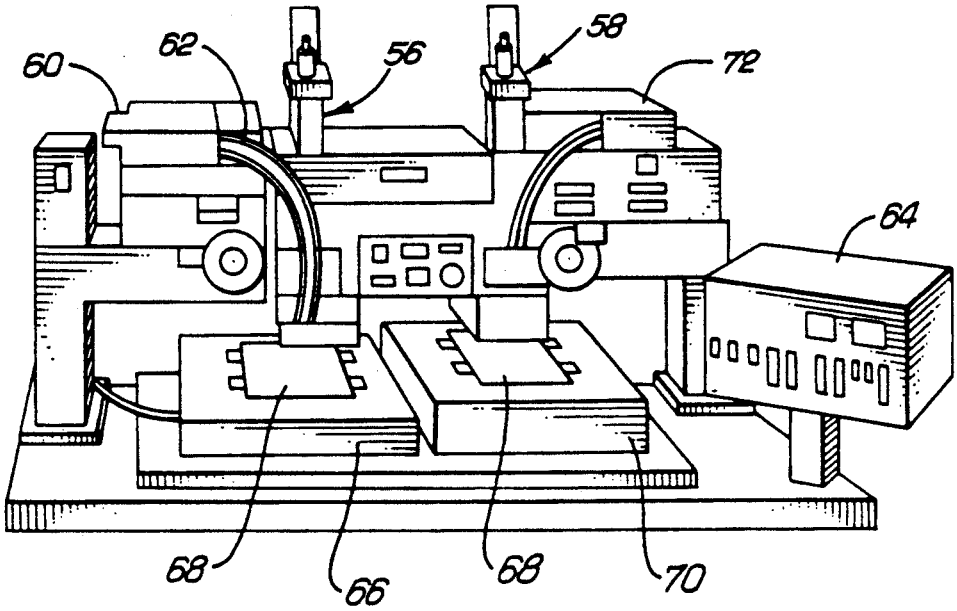
FIG. 5 is a perspective view of an automatic system for the manufacture of the electrical jumper.

As shown in FIG. 5, an automatic system can be used to manufacture the electrical jumper assembly 10. The system includes an insertion station 56 where the terminal pins 14 are inserted into the flexible cable 12 and a staking station 58 where the terminal pins 14 are swaged to the stiffener 16. The insertion station 56 includes a vibrating feed bowl 60 which is filled with terminal pins 14. The vibrating feed bowl 60 includes a vertically inclined feed track 62 for delivery of the terminal pins 14. A microprocessor control unit 64 controls the movement of the vibrating bowl 60 so that one terminal pin 14 is delivered down the inclined feed track 62 to a predetermined location. The flexible cables 12 (not shown) are loaded on top a locating fixture 68. An operator places the locating fixture 68 onto an x-y table 66 which is located beneath the feed track 62. The microprocessor control unit 64 is then activated to insert the pins 14. The unit 64 synchronizes the movement of the x-y table 6.6 so that each of the holes of the flexible cable 12 are positioned at the predetermined location at the proper time for insertion of the pin 14.

After insertion of the terminal pins 14, a hold-down plate (not shown) is installed on the locating fixture 68. The resulting structure is then loaded onto a second x-y table 70 under the staking station 58. The operator then activates the microprocessor control unit 64. The x-y table 70 moves automatically to preprogrammed positions, while a staking mechanism 72 swages the terminal pins 14 with a specially designed form tool. The electrical jumper assemblies 10 are then ready for high temperature soldering. As shown in FIG. 4, the flange 34 is preferably soldered with high temperature solder 54 to the conductive pad 28. A high temperature solder such as SN5 ensures that the physical stability of the electrical jumper assembly 10 is not affected when the terminal pins 14 are wave soldered to the female connectors of the circuitry. Because the soldered joint is completely inspectable the configuration meets MIL-STD 2000.

A preferred embodiment of the present invention has been described. Nevertheless, it will be understood that various modifications may be made without departing from the spirit and scope of the invention. For example, the flexible cable 12 illustrated in FIGS. 1–3 may contain, if desired, a single flexible conductor 26. In addition, when there are multiple flexible conductors 26, the conductors 26 need not be in parallel, but can go in different directions in the plane of insulating material. The flexible conductor 26 can also terminate at one or both ends in a conductive pad 28. Various materials can be used for the terminal pins, flexible conductors, insulating layers, adhesives and stiffeners depending on the specific application. Furthermore, the terminal pins 14 can be fastened to the flexible cable 12 by means other than swaging the pins 14 to the stiffener 16. For example, the terminal pins 14 can be glued to the stiffener 16. The present invention is also not limited to use with rigid printed circuit boards. Other types of electrical and electronic components may be connected. Thus, the present invention is not limited to the preferred embodiments described herein, but may be altered in a variety of ways which will be apparent to persons skilled in the art.

I claim:

1. An electrical jumper assembly, comprising:

a flexible cable having at least one flexible conductor encapsulated in an insulating material, the conductor terminating in a conductive pad, the pad having a contact surface and a non-contact surface and a hole extending from the contact surface to the non-contact surface;

a stiffener member having an outer surface and opposing inner surface and a hole extending from the outer surface to the inner surface, the inner surface of the stiffener facing toward the non-contact surface and being disposed so that the pad hole and the stiffener hole are substantially aligned; and a separate terminal pin being electrically connected to the conductive pad and extending through the pad hole and the stiffener hole, the pin having a contact end and an opposing non-contact end, the contact end adapted for engaging a female connector and the non-contact end being swaged to the stiffener.

2. The electrical jumper assembly of claim 1, wherein the non-contact end of the terminal pin defines a cavity.

3. The electrical jumper assembly of claim 1, wherein a portion of the contact end of the terminal pin is substantially cylindrically shaped.

4. The electrical jumper assembly of claim 1, wherein the terminal pin has a flange located between the ends, the flange resting on the contact surface of the pad.

5. The electrical jumper assembly of claim 1, wherein the flexible conductor is ribbon shaped and terminates in a conductive pad at each end.

6. The electrical jumper assembly of claim 1, wherein the flexible cable includes a laminate structure of a plurality of flexible parallel conductors and a top and bottom insulating layer bonded to opposite sides of the conductors to form a laminated structure.

7. The electrical jumper assembly of claim 1, wherein the stiffener covers the area of the insulating material where the flexible conductors terminate in conductive pads.

8. The electrical jumper assembly of claim 1, wherein the terminal pin is secured by being swaged to the outer surface of the stiffener.

9. The electrical jumper assembly of claim 4, further comprising high temperature solder which adheres to a portion of the flange and the contact surface of the conductive pad.

10. The electrical jumper assembly of claim 8, further comprising a potted material which forms a protective layer over the swaged portion of the terminal pins.

* * * * *